US005242466A

United States Patent [19]

Aseervatham et al.

[11] Patent Number: 5,242,466

[45] Date of Patent: Sep. 7, 1993

[54] REACTIVE DYEBATH ADDITIVE:POTASSIUM SILICATE AND POTASSIUM HYDROXIDE

[75] Inventors: Theodore D. Aseervatham, Yorkshire; Marc Ballman; James Hayes, both of Cheshire, all of Great Britain

[73] Assignee: Unilever Patent Holdings B.V., Vlaardingen, Netherlands

[21] Appl. No.: 849,605

[22] Filed: Mar. 12, 1992

[30] Foreign Application Priority Data

Mar. 12, 1991 [GB] United Kingdom ..... 9105247

[51] Int. Cl.[5] ..... D06M 11/38; D06M 11/79; D06P 1/673; D06P 3/66

[52] U.S. Cl. ..... 8/543; 8/632; 8/918

[58] Field of Search ..... 8/543, 632, 918

[56] References Cited

U.S. PATENT DOCUMENTS 2,497,519 2/1950 Stevenson et al. ..... 8/125
3,843,318 10/1974 von der Eltz ..... 8/543
4,092,101 5/1978 Dillmann ..... 8/549
4,184,842 9/1980 von der Eltz ..... 8/537

FOREIGN PATENT DOCUMENTS 0283114 9/1988 European Pat. Off. .
8606425 11/1986 World Int. Prop. O. .

OTHER PUBLICATIONS

"The Dyeing of Cellulosic Fibres", (edited by C. Preston), Dyer's Company Publications Trust, 1986, p. 4.
"The Encyclopedia of Organic Chemistry", Kirk Othmer, Third Edition, Supplement vol., 1979, pp. 308–310.

*Primary Examiner*—A. Lionel Clingman
*Attorney, Agent, or Firm*—Cushman, Darby & Cushman

[57] ABSTRACT

A fabric is dyed with a reactive dye in the presence of an alkali donor, added to the dyebath. The alkali donor is a liquid composition comprising potassium silicate and potassium hydroxide. A composition suitable for use as such an alkali donor comprises, by weight of the total weight of the composition, 20–75% potassium silicate, 10–35% of solid potassium hydroxide, and up to 20% sequestrant, the balance comprising water.

9 Claims, No Drawings

REACTIVE DYEBATH ADDITIVE:POTASSIUM SILICATE AND POTASSIUM HYDROXIDE

FIELD OF THE INVENTION

This invention relates to a dyebath additive, and in particular to an alkali donor for a reactive dye bath.

BACKGROUND OF THE INVENTION

Conventionally, reactive dyes are applied to a fabric by (a) adding the dyestuff to a dyebath containing a fabric, usually cotton, to be dyed, then (b) "salting out" the dye by addition of an electrolyte and then (c) "fixing" the dye on the fabric by the addition of an alkali donor. In this "fixation" process, the pH of the system is adjusted to a level in the alkaline region which promotes reaction between the reactive dye and the cellulosic substrate; see "The Encyclopedia of Organic Chemistry", Kirk Othmer, 3rd Edn., Supplement Vol., 1979, pages 308–310, and "The Dyeing of Cellulosic Fibres", Ed. Clifford Preston, Dyers' Company Publications Trust, 1986, page 4.

The alkali donor most commonly used is sodium carbonate or a mixture thereof with caustic soda; see "The Dyeing of Cellulosic Fibres" (supra).

However, sodium carbonate is a powder which is inconvenient to handle, especially on preparation of a dilute solution for addition to the dyebath or indeed on direct addition to the dyebath (serious dusting can occur), and difficult to store (the powder is prone to caking). Furthermore, on an industrial scale, it is necessary to add large quantities of the powder and this usually involves several additions to the dyebath.

As an alternative, small quantities of caustic soda alone have been added, but careful addition to the dyebath is then necessary, there being a serious danger that the dyer would inadvertently add too much of this and so damage the fabric.

It is also known to use an aqueous solution containing a mixture of sodium silicate and caustic soda in pad dyeing (U.S. Pat. No. 3,843,318) and printing (U.S. Pat. No. 4,092,101) processes. However, at least for some reactive dyes, especially for dyeings applied by immersion in a dyebath, a particularly deep shade is not obtained.

EP-A-0283114 discloses a liquid donor composition containing, as the major ingredient, tripotassium phosphate, together with caustic potash and potassium carbonate. Other alkali donors containing phosphorus compounds such as phosphonates are also known. However, such phosphorus compounds tend to cause environmental difficulties and in certain countries, their use is prohibited.

SUMMARY OF THE INVENTION

Surprisingly, we have found that excellent fixation may be achieved by a single addition of a mixture of potassium silicate and caustic potash.

In particular, as compared, for example, with an aqueous sodium silicate/caustic soda solution at the same concentration, we find that improved solids activity can be achieved, which manifests itself in improved colour yield and dye fastness, and improved buffering efficiency. Furthermore, a concentrated aqueous solution has a lower viscosity than that of a sodium silicate/caustic soda solution at the same concentration.

Thus, the liquid is easy to handle, no dissolution is required and, if desired, all of the liquid required can be added at once to the dyebath.

It is found that a depth of shade can be achieved which is at least as deep as that achieved when using very much larger quantities of sodium carbonate.

In a conventional reactive dyeing process, a sequestering agent is also added to the dyebath in order to mop up cations which might adversely affect the dyeing process, such as calcium, magnesium, iron and copper. This sequestering agent can be added to an alkali donor composition embodying the invention, which usually also additionally contains a small quantity of water.

Typical sequestering agents are, for example, the sodium salt of ethylene diamine tetra-bis phosphonic acid (EDTP), commercially available as Masquel P430 Na (available from Protex Limited) and Dequest (available from Monsanto), ethylene diamine tetra acetic acid (EDTA) sodium salt, nitrilotriacetic acid (NTA) sodium salt, phosphonic acid esters and sodium gluconate.

In the potassium silicate, the ratio of $SiO_2$:$K_2O$ may vary, and preferably varies within a weight ratio range of from 1.4 to 2.5 (molar ratio range 2.2 to 4), more preferably a weight ratio range of from 1.43 to 2.48 (molar ratio range 2.24 to 3.89), especially a weight ratio range of from 1.43 to 2.09 (molar ratio range 2.24 to 3.28).

The various components in the composition may be present in the following proportions.

| | Preferred Range wt % | More Preferred Range wt % |
|---|---|---|
| Potassium silicate (solid) | 20–75 | 25–40 |
| Potassium hydroxide (solid) | 10–35 | 20–30 |
| Sequestrant | 0–20 | 1–10 |
| Water | Balance | Balance |

The composition may be present in the dyebath at a concentration of up to 5 g/l, preferably from 1–4 g/l, especially 2–2.5 g/l.

Typical reactive dyes which can be applied are CI Reactive Yellow 27, CI Reactive Yellow 64, CI Reactive Yellow 84, CI Reactive Red 104, CI Reactive Red 141, CI Reactive Blue 71, CI Reactive Blue 108, CI Reactive Blue 114, CI Reactive Brown 19 and CI Reactive Black 5.

DESCRIPTION OF PREFERRED EMBODIMENTS

Examples of the use of an alkali donor embodying the invention will now be described with reference to the following Examples.

EXAMPLE 1

Laboratory Dyeing

A bleached cotton fabric was dyed with a mixture of dyestuffs as given below, the amounts being by weight of fabric.

1.09% CI Reactive Red 141
4.5% CI Reactive Blue 108
1.2% CI Reactive Yellow 84

Prior to addition of the dyestuff mixture, 15 g of the fabric was circulated in 300 ml of water in the dyebath of a John Jeffries Laboratory Machine containing 1 g/l lubricant, namely Dyelube NF (an anionic polymer, commercially available from Joseph Crosfield & Sons Ltd) and 1 g/l of a sequestrant, namely Croscolor QEST (a sodium salt of an organic acid, commercially available from Joseph Crosfield & Sons Ltd), in the cold for ten minutes. This gave a liquor:fabric ratio of 20:1.

The dyestuff mixture, having been dissolved in water and the solution filtered, was then added, and the dyeing machine run for ten minutes. Salt was then added to the dyebath in an amount of 80 g/l and the liquor was circulated for fifteen minutes. The temperature of the liquor was then raised to a dyeing temperature of 80° C. over thirty minutes and maintained at that temperature to ensure a maximum dye exhaustion.

An alkali donor composition was then added in an amount of 2 g/l and dyeing was continued for between thirty and forty-five minutes until the desired shade had been obtained. The experiment was carried out using several alkali donor compositions, containing various commercially available aqueous silicate compositions, as indicated in Table 1 below. The shade was then checked against a standard obtained by carrying out the same experiment, but using 20 g/l of sodium carbonate, added as various times in amounts of 5 g over a period of 20 minutes.

The fabric was then subjected to a soaping off process in which it was boiled for twenty minutes in 1 g/l Croscolor ARW, an anionic dye-suspending agent, commercially available from Joseph Crosfield & Sons Ltd, followed by fixation by treatment in a bath of a cationic fibre-substantive exhaustion resin, namely Croscolor NOFF (commercially available from Joseph Crosfield & Sons Ltd), at a pH of 4.5 and a temperature of 40° C.

Experiments A–I were carried out using compositions embodying the invention, some with different amounts of of potassium silicate and some with potassium silicates having different $SiO_2$:$K_2O$ ratios. Experiments J–M were carried out for comparison and contained sodium silicates having different respective silica soda ratios (Experiments J–K and L–M) and containing either caustic potash (Experiments J and L) or caustic soda (Experiments K and M).

All of experiments A–M gave dyeings to a shade at least as good as that using sodium carbonate. However, experiments A–I gave considerably more efficient fixation leading both to an even better depth of shade and an improved fastness as compared with experiments J to M. Furthermore, the viscosity of the formulations in experiments J to M was somewhat high and made handling difficult whereas that of the formulations A–I was lower and the solutions were easy to handle.

TABLE 1

| ALKALI DONOR | EXPERIMENT (Figures represent % by weight) | | | | | | | | | | | | |
|---|---|---|---|---|---|---|---|---|---|---|---|---|---|
| Components | A | B | C | D | E | F | G | H | I | J* | K* | L* | M* |
| Potassium Silicate (aqueous)[1] | 50 | 40 | 32 | | | | | | | | | | |
| Potassium Silicate (aqueous)[2] | | | | 50 | 40 | 32 | | | | | | | |
| Potassium Silicate (aqueous)[3] | | | | | | | 50 | 40 | 32 | | | | |
| Sodium Silicate (aqueous)[4] | | | | | | | | | | 32 | 32 | | |
| Sodium Silicate (aqueous)[5] | | | | | | | | | | | | 32 | 32 |
| Solid KOH | 20 | 20 | 20 | 20 | 20 | 20 | 20 | 20 | 20 | 20 | | 20 | |
| Solid NaOH | | | | | | | | | | | 20 | | 20 |
| Masquel P43ONa[6] | 20 | 10 | 6 | 20 | 10 | 6 | 20 | 10 | 6 | 6 | 6 | 6 | 6 |
| Water | 10 | 30 | 42 | 10 | 30 | 42 | 10 | 30 | 42 | 42 | 42 | 42 | 42 |

Notes to Table 1:
*Comparative Experiments
[1]Si $O_2$:$K_2O$ weight ratio 1:43 and mean solids content 52.4%
[2]Si $O_2$:$K_2O$ weight ratio 2:14 and mean solids content 39.1%
[3]Si $O_2$:$K_2O$ weight ratio 2:48 and mean solids content 29.9%
[4]Si $O_2$:$Na_2O$ weight ratio 1:60 and mean solids content 46.7%
[5]Si $O_2$:$Na_2O$ weight ratio 3:30 and mean solids content 38.0%

EXAMPLE 2

Industrial Scale Dyeing (Best Method)

Using the same dyestuff mixture as in Example 1, 100 kilo of bleached cotton fabric was circulated in the dyebath of an industrial dyeing machine containing 1 g/l Dyelube NF and 1 g/l Croscolor QEST in the cold for ten minutes. The liquor:fabric ratio was 10:1. A filtered solution of the above dyestuffs was then added in an amount sufficient to give the same proportions, by weight of fabric as in Example 1, and the dyeing machine run for ten minutes.

Common salt was then added in an amount of 80 g/l and circulation was continued for fifteen minutes. The dye liquor was then raised to a dyeing temperature of 80° C. over thirty minutes and maintained at that temperature for a further thirty minutes to ensure maximum dye exhaustion. The same alkali donor composition as that used in Experiment A of Example 1 was then added and dyeing was continued for forty-five minutes until the required shade was obtained. The alkali donor was present in an amount of 1 g/l, i.e. 10 kg per dye load of 100 kg fabric in 1000 liters liquor. The same experiment was carried out, but using 100 kilo of sodium carbonate, added over a period of time in portions of 25 kilo.

After soaping off and fixation in the same manner as that described in Example 1 but on a larger scale, the shades of the dyeings obtained using the liquid composition of the invention and sodium carbonate respectively were compared and found to be roughly the same.

This shows that an excellent dyeing shade can be achieved using a liquid composition embodying the invention without the difficulties in storing and handling and without the need to add large quantities of sodium carbonate powder used conventionally. Furthermore, these results are achieved using roughly only one-tenth the amount of alkali donor. In addition, since the composition embodying the invention is liquid, no problems associated with dissolving the alkali donor are encountered.

We claim:

1. In a method of dyeing a cellulosic fabric with a reactive dye, in which an alkali donor is added to the dyebath to fix the dye, the improvement which comprises using, as the alkali donor, up to 5 grams per liter of dyebath, of a liquid composition comprising potassium silicate and potassium hydroxide wherein the potassium silicate has a molar ratio of $SiO_2:K_2O$ of from 2.2 to 4:1 inclusive.

2. A method according to claim 1, wherein the potassium silicate is present in an amount of from 20% to 75% by weight of the total weight of the composition.

3. A method according to claim 1, wherein the composition additionally includes a sequestrant.

4. A method according to claim 1, wherein the alkali donor composition is present in the dyebath in an amount such as to provide a concentration of potassium silicate in the dyebath up to 5% by weight of the dyebath liquor.

5. A composition suitable for use as an alkali donor comprising, by weight, of the total weight of the composition, 20–75% of potassium silicate having a molar ratio of $SiO_2:K_2O$ of from 2.2 to 4:1 inclusive 10–35% of solid potassium hydroxide, and up to 20% of a sequestrant, the balance comprising water.

6. A composition according to claim 5, wherein the amount of potassium silicate is from 25–40% by weight of the total weight of the composition.

7. A composition according to claim 5, wherein the amount of potassium hydroxide is from 20–30% by weight of the total weight of the composition.

8. A composition according to claim 5, wherein the sequestrant is present in an amount of from 1 to 10% by weight of the total weight of the composition.

9. An aqueous dyebath comprising a reactive dye and an alkali donor, the donor being present in a concentration of up to 5 grams per liter of dyebath and consisting essentially of potassium silicate and potassium hydroxide wherein the potassium silicate has a molar ratio of $SiO_2:K_2O$ of from 2.2 to 4:1 inclusive.

* * * * *